United States Patent [19]

Ford

[11] 4,062,286

[45] Dec. 13, 1977

[54] DESIGN PAINTING KIT

[76] Inventor: Mary Jane Ford, 4157 SW. 49 Court, Fort Lauderdale, Fla. 33314

[21] Appl. No.: 721,334

[22] Filed: Sept. 8, 1976

[51] Int. Cl.[2] ..... B41F 17/26

[52] U.S. Cl. ..... 101/375; 35/26; 101/212

[58] Field of Search ..... 401/218; 35/26, 27, 35/28; 101/368, 375, 376, 205, 211, 33, 212, 327, 328

[56] References Cited

U.S. PATENT DOCUMENTS

| | | | |
|---|---|---|---|
| 1,070,763 | 8/1913 | Bauman et al. | 101/329 |
| 2,712,189 | 7/1955 | Grossman | 35/26 |
| 2,753,641 | 7/1956 | Dorman | 101/328 |
| 2,805,436 | 9/1957 | Christensen et al. | 101/329 |
| 3,134,327 | 5/1964 | Sebanc | 401/218 |
| 3,408,932 | 11/1968 | Mucci | 35/26 |
| 3,537,394 | 11/1970 | Swapp | 101/328 |
| 3,785,288 | 1/1974 | Hunter | 101/348 |

FOREIGN PATENT DOCUMENTS

| | | | |
|---|---|---|---|
| 680,173 | 10/1952 | United Kingdom | 35/26 |

*Primary Examiner*—Edgar S. Burr
*Assistant Examiner*—William Pieprz
*Attorney, Agent, or Firm*—Robert D. Farkas

[57] ABSTRACT

A design painting kit having a paint roller which carries an embossed rubber-like mat upon the rotatable cylindrical surface thereof. The embossing includes design indicia and numerical indicia which signifies the color of paint to be applied to discreet areas of the design. An ink roller is removably affixed to the handle of the paint roller having the ink laden exterior surface thereof adapted to coat the embossed surfaces of the rubber mat as the rubber mat is rolled upon the surface of a wall, thereby applying an ink depiction of the pattern and numerical indicia thereto. The kit also includes a hand operated block or plate which can carry a rubber-like mat and is useful in applying the embossed indicia surfaces upon small surfaces to be decorated or upon otherwise inaccesible portions of the wall. The kit also provides a container including a supply of ink, a quantity of individually colored paints in separate containers, and a quantity of brushes.

1 Claim, 7 Drawing Figures

DESIGN PAINTING KIT

BACKGROUND OF THE INVENTION

1. Field of the Invention

This invention relates to painting apparatus and more particularly to that class of kits of implements suitable for applying decorative patterns to broad surfaces.

2. Description of the Prior Art

The prior art abounds with painting kits utilizing numerals to instruct the user as to the location of the application of various colors of paint to form a pleasing colored pattern. U.S. Pat. No. 2,712,189 issued on July 5, 1955 to R. E. Grossman teaches a painting kit in which a plurality of sheets of material are provided, wherein each sheet carries a pattern having discreet areas thereof identified by numerals so as to assist the user in choosing the location for the various colors of paints also supplied.

U.S. Pat. No. 2,744,349 issued on May 8, 1956 to R. E. Grossman discloses the method of painting consistent with his apparatus disclosed in U.S. Pat. No. 2,712,189.

Both of the aforementioned patents, though teaching the principle of and supplying the apparatus for the creation of a painting utilizing numerals as a means of instruction, suffer the common deficiency of requiring the user to obtain a sheet or plaque bearing an individual pattern. Thus, the user is restricted to the painting of a single pattern covering a relatively small area and may not utilize the painting by numeral system in the decorative designing of walls or other large lateral surfaces wherein the designs are repeatedly depicted on the large lateral surface.

SUMMARY OF THE INVENTION

A primary object of the present invention is to provide a painting kit which may be utilized to apply design and numerical indicia in repeated locations on a lateral surface.

Another object of the present invention is to provide a kit which includes a quantity of diverse designs.

Still another object of the present invention is to provide as part of the kit apparatus, an ink applying roller which permits the repeated application of the pattern and numerical indicia to a large lateral surface.

Yet another object of the present invention is to provide a hand block carrying the design and numerical indicia for use in reproducing single or isolated applications of an ink pattern representing the indicia on smaller lateral surfaces.

A further object of the present invention is to provide a kit in accordance with the preceding objects, which is simple in construction, relatively inexpensive and effective for its particular purpose.

Hand block printing has been used heretofore to provide a design for wall coverings and fabrics. However, due to the substantially rigid construction of a hand block paint carrying surface, hand blocks are unsuitable for use in applying ink patterns upon the irregular surfaces of walls. An unpainted wall surface or a wall surface securely covered by a fabric made of wall paper which is in good condition, may be salvaged and beautifully decorated if an overlay of repeated patterns are acurately inked thereupon, followed by selectively colorably painting discreet areas of the patterns with variously colored paints.

The present invention successfully overcomes these problems and meets these needs by the application of repeated ink patterns being applied to the surface of a wall. The present invention also provides an ink applying apparatus suitable for applying the same pattern to a small sheet or to a portion of the wall otherwise inaccessible.

These objects as well as other objects of the present invention, will become more readily apparent after reading the following description of the accompanying drawings.

DESCRIPTION OF THE PREFERRED EMBODIMENT

The structure and method of fabrication of the present invention is applicable to a paint roller, of the conventional variety, but having a smooth cylindrical surface in the place of the conventional paint laden surface. A plurality of rubber-like pads are provided. Each pad is equipped with a lateral surface having embossed indicia. The indicia depicts a pattern having discreet areas, each indentified by a numeral useful in advising the user as to the color of the paint to be applied thereover. Each rubber-like pad has the non-indicia bearing lateral surface thereof coated with a pressure sensitive adhesive permitting the pad to be attached to the smooth cylindrical surface of the roller. A second cylindrical roller is journaled to a frame. The frame is removably secured to a portion of the handle of the paint roller such that the second cylindrical surface is in touching engagement with the embossed edges of the pad. The exterior surface of the second cylindrical roller comprises an ink impregnated resilient material, such as an open cell polyurethane foam plastic material fixedly secured thereto.

The kit also includes a flat plate having a cylindrical rod affixed thereto serving as a handle. The adhesive layer backing of the rubber-like pads permits the rubber-like pads to be selectively mounted on a lateral surface of the plate. When so mounted, the rubber-like pad may by inked by operating the embossed areas in sliding touching engagement with the second cylindrical roller. The kit also includes a container which houses a quantity of ink and a plurality of containers each housing a quantity of paint, each container containing different colored paint from the others. Paint brushes are provided to facilitate the application of different colored paints to the variously numerically identified areas of the pattern.

Figure 1:
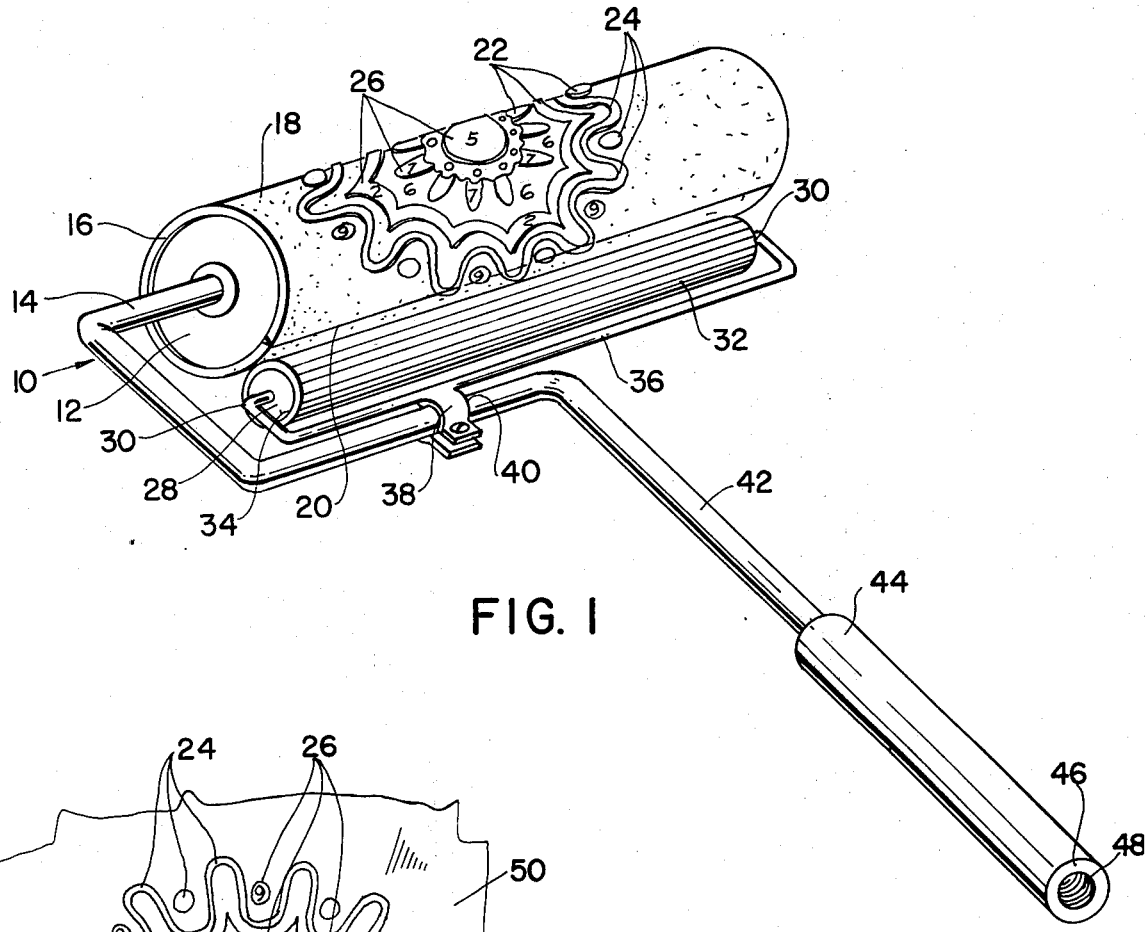
FIG. 1 is a perspective view of a paint roller carrying a rubber-like pad having embossed indicia thereupon, a cylindrical ink pad is also illustrated.

Now referring to the Figures, and more particularly to the embodiment illustrated in FIG. 1 showing a paint roller 10 having a rotatable roller 12 journaled about shaft portion 14. Roller 12 is provided with a smooth cylindrical surface 16 to which rubber-like pad 18 is removably affixed. The surface of pad 18 contacting cylindrical surface 16 is coated with a pressure sensitive adhesive not shown. Line 20 depicts the marginal edges of pad 18 disposed in touching engagement when otherwise flat pad 18 is rolled up and adhered to cylindrical surface 16. Embossed indicia 22 is disposed on the outermost surface of pad 18 and contains design lines 24 and numerical indicia 26, disposed in discreet areas of the design. A second cylindrical roller 28 is shown journaled to shaft 30 such that the exterior surface 32 of roller 28 is in touching engagement with indicia 22 on pad 18. Exterior surface 32 comprises an ink laden resilient material fixedly secured to cylindrical surface 34 of roller 28. Shafts 30 are joined so as to form frame 36 which is removably secured by way of clamp 38 to point 40 on handle 42 of roller 10. A hand grasping handle 44 is provided at the free end of shaft 42 and extends substantially normal to the axis of rotation of cylinder 12. The free end 46 of handle 44 is provided with an opening 48 suitable for securing a shaft extension to handle 44, thereby facilitating the use of the paint roller at extended heights and distances from the body of the user. Cylindrical surface 32 rolls upon embossed indicia 22 when cylinder 12 is rotated by engagement with a large lateral surface, such as a wall, causing the ink carried by roller 28 to be transferred to the embossed surfaces on pad 18.

Figure 2:
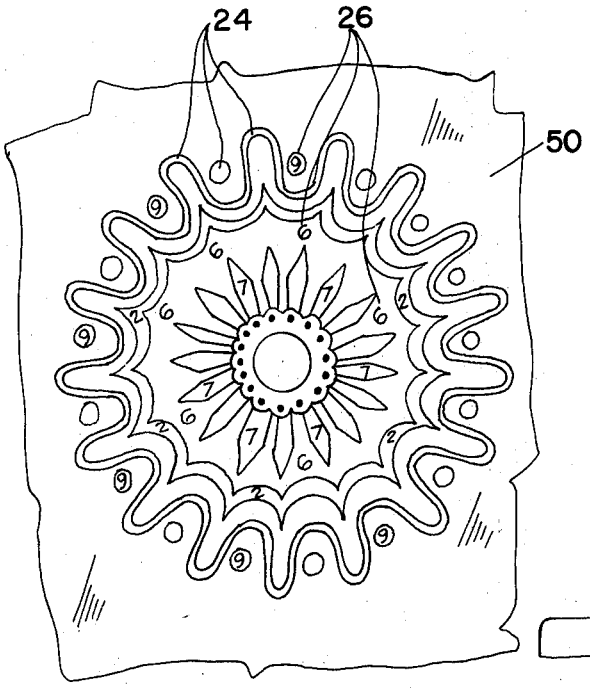
FIG. 2 is a plan view of the indicia carried by the rubber-like pad shown in FIG. 1.

FIG. 2 illustrates a substrate 50 upon which an ink representation of pattern lines 24 and numerical indicia 26 have been deposited. Each similarly numerically identified area may be painted with a selected color of paint so as to create a pleasing and interesting colored pattern.

Figure 3:
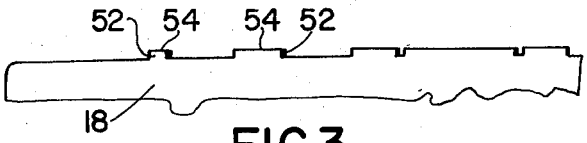
FIG. 3 is a partial side elevation view of the rubber-like pad utilized in FIG. 1.

FIG. 3 illustrates pad 18 showing embossed portions 52 thereon. The outermost surfaces 54 of the embossed portions 52 carry ink for deposition on a lateral surface such as substrate 50 as shown in FIG. 2.

Figure 4:
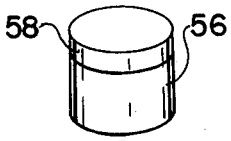
FIG. 4 is a perspective view of a container used to house ink.

FIG. 4 illustrates container 56 having a removable lid 58, suitable for use in storing a quantity of ink therein. The ink may be utilized to refurbish the supply of ink at surface 32, as shown in FIG. 1.

Figure 5:
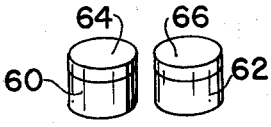
FIG. 5 is a perspective view of a plurality of containers utilized to carry various colors of paint.

FIG. 5 illustrates containers 60 and 62, each having lids 64 and 66 respectively. Containers 60 and 62 each house a quantity of paint.

Figure 6:
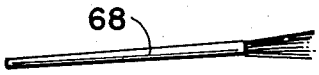
FIG. 6 is a side elevation view of a paint brush.

FIG. 6 illustrates a paint brush 68, typical of a plurality of paint brushes supplied as part of the kit disclosed herein.

Figure 7:
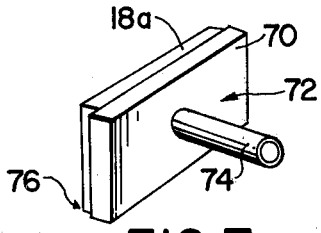
FIG. 7 is a perspective view of a hand block and handle shown carrying a rubber-like pad.

FIG. 7 illustrates a plate 70 having a lateral surface 72 to which one end of a cylindrical rod 74 is affixed. Pad **18*a* is shown affixed to lateral surface 76 of plate 70 uitlizing the adhesive layer, not shown, affixed to the unembossed side of pad 18*a*** therefor.

One of advantages of the present invention is a painting kit which may be utilized to apply design and numerical indicia in repeated locations on a lateral surface.

Another advantage of the present invention is a kit which includes a quantity of diverse designs.

Still another advantage of the present invention is, as part of the kit apparatus, an ink applying roller which permits the repeated application of the pattern and numerical indicia to a large lateral surface.

Yet another advantage of the present invention is a hand block carrying the design and numerical indicia for use in reproducing single or isolated applications of an ink pattern representing the indicia on smaller lateral surfaces.

A further advantage of the present invention is a kit in accordance with the preceding advantages, which is simple in construction, relatively inexpensive and effective for its particular purpose.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A design painting kit comprising:

a. a first design applying means including a first cylindrical tube, a handle having a hand grasping portion thereon, a rod, one end of the rod extending into said first tube and said first tube journalled to and co-axially aligned with the longitudinal axis of said rod for rotation thereabout, the other end of said first cylindrical tube undergoing two right angle bends to form a U-shaped portion with said first tube journalled about a first leg thereof, and a second leg thereof extending parallel to said first leg and to said tube, said second leg undergoing a third right angle bend at a point along the length of said second leg midway between the ends of said first tube, said handle fixedly secured to and coaxially aligned with said other end of said rod at a point beyond said third right angle bend, said hand grasping portion of said handle having a hole therein, said handle having a cylindrical shape, the longitudinal axis of said hole being positioned in co-axial alignment with said hand grasping portion of said handle, a plurality of rubber-like pads, one lateral surface of each of the rubber-like pads carrying a pressure sensitive adhesive, one of said rubber-like pads being disposed removably secured to the exterior surface of said first cylindrical tube, the other lateral surface of each of said rubber-like pads carrying embossed indicia, the embossed indicia including a design outline and further including numerals depicting selected areas of the design, a second cylindrical tube, the second cylindrical tube having an ink impregnated resilient material fixedly secured thereto, the second cylindrical tube removably secured to the rod at a point between the ends of said second leg of said U-shaped portion of said rod, said second cylindrical tube being journalled for rotation about its longitudinal axis, the axis of rotation of said second cylindrical tube being disposed in spaced apart and parallel relationship with the axis of rotation of said first cylindrical tube, the exterior surface of the ink impregnated resilient material being disposed in touching ink-transferring engagement with a portion of said embossed indicia;

b. a second design applying means including a plate, a shaft, one end of said shaft being disposed fixedly secured in perpendicular relation to one lateral surface of the plate, another of said rubber-like pads being disposed removably secured to the other lateral surface of said plate, a container, the container containing a quantity of ink;

c. a plurality of paint containers, said plurality of paint containers each containing a quantity of individually colored paint bearing a predetermined relation to said numerical indicia, and a plurality of brushes;

whereby said first and second design applying means are selectively operable to print said design outline on a substrate, said design including said numerical indicia and wherein at least one of said plurality of brushes is utilized to apply at least one of said colored paints to the interior of said design outline in accordance with said numerical indicia printed onto said substrate by said first and second design applying means.

* * * * *